US009714661B2

(12) United States Patent
Ashida et al.

(10) Patent No.: US 9,714,661 B2
(45) Date of Patent: Jul. 25, 2017

(54) VACUUM PUMP

(71) Applicant: Shimadzu Corporation, Kyoto (JP)

(72) Inventors: Osamu Ashida, Kyoto (JP); Kohei Oue, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 171 days.

(21) Appl. No.: 13/955,340

(22) Filed: Jul. 31, 2013

(65) Prior Publication Data

US 2014/0056735 A1 Feb. 27, 2014

(30) Foreign Application Priority Data

Aug. 24, 2012 (JP) ..... 2012-185509

(51) Int. Cl.
*F04D 19/04* (2006.01)
*F04D 29/08* (2006.01)
*F04D 29/063* (2006.01)

(52) U.S. Cl.
CPC ..... *F04D 19/042* (2013.01); *F04D 29/063* (2013.01); *F04D 29/083* (2013.01)

(58) Field of Classification Search
CPC .... F04D 19/042; F04D 29/063; F04D 29/083; F04D 29/662; F04D 29/059
See application file for complete search history.

(56) References Cited

U.S. PATENT DOCUMENTS 4,199,154 A * 4/1980 Mueller ..... F16J 15/40 277/420
5,124,997 A * 6/1992 Funakubo et al. ..... 372/58
6,705,844 B2 * 3/2004 Englander ..... F04D 29/083 277/400
7,059,828 B2 * 6/2006 Conrad et al. ..... 415/170.1
(Continued)

FOREIGN PATENT DOCUMENTS

JP 62-288386 12/1987
JP 1-102498 7/1989
JP 2002-317790 10/2002
(Continued)

OTHER PUBLICATIONS

Chinese Office Action dated Aug. 14, 2015 for corresponding Chinese Application No. 201310339850.x and English translation.
(Continued)

*Primary Examiner* — Bryan Lettman
(74) *Attorney, Agent, or Firm* — Renner, Otto, Boisselle & Sklar, LLP

(57) ABSTRACT

A vacuum pump which, among others, has a lubricated ball bearing for supporting a rotor shaft of a motor, a bearing holder for holding the lubricated ball bearing, a first labyrinth seal provided between a motor arrangement space and a bearing arrangement space, and a balance adjustment member installed at a position of the rotor shaft to face the bearing holder and used for balance adjustment of a rotating body. A second concave and convex part to be fitted to the
(Continued)

first concave and convex part forming the first labyrinth seal. By reducing a gap of the bearing arrangement space, the space in which the oil vapor is filled is reduced. Therefore, a moving amount of the gas, and thus, the decrease in the base oil of the lubricant can be suppressed, thereby extending the lubricating life.

13 Claims, 5 Drawing Sheets

(56) References Cited

U.S. PATENT DOCUMENTS

2008/0095613 A1* 4/2008 Blanchard ..... F01D 5/027
415/140

FOREIGN PATENT DOCUMENTS

JP 2005-240690 A 9/2005
JP 2006-138216 A 6/2006

OTHER PUBLICATIONS

English translation of Japanese Office Action dated May 31, 2016 for corresponding Japanese Application No. 2012-185509.
English Translation of Chinese Office Action dated Jan. 22, 2016 for corresponding Chinese Application No. 201310339850.x.

* cited by examiner

VACUUM PUMP

BACKGROUND OF THE INVENTION

1. Field of the Invention

The present invention relates to a vacuum pump in which a rotor is supported by a lubricated ball bearing.

2. Description of the Related Art

In a vacuum pump in which a ball bearing is used as a bearing for supporting a rotor, lubrication of the ball bearing comes to an issue. In a dry vacuum pump described in Japanese Unexamined Patent Publication No. 2002-317790, a labyrinth seal is provided between a space in which a motor and a ball bearing are arranged and a pump exhaust port side. With such a configuration, a reverse flow of oil vapor to an intake port side is prevented.

The invention described in Japanese Unexamined Patent Publication No. 62-288386 is a vacuum pump in which a lower part of a rotating body is supported by a spherical spiral groove bearing, and a lip seal plate is provided for a rotor shaft, so that oil and oil vapor are prevented from leaking out to an exterior of an oil container.

However, in a case of the configuration described in Japanese Unexamined Patent Publication No. 2002-317790, the oil vapor goes over the entire arrangement space of the motor and the bearing. Therefore, when a pressure is changed on the pump exhaust port side, a gas flows into the arrangement space or the gas flows out from the arrangement space via the labyrinth seal, and in accordance with the flow-out of the gas, the oil vapor of the arrangement space also flows out. As a result, oil used as a lubricant of the bearing (base oil in a case of grease lubrication) is decreased, so that the life of the lubricant is deteriorated.

In a case where the lip seal plate described in Japanese Unexamined Patent Publication No. 62-288386 is used, in order to make the lip seal plate bearable for high-speed rotation, there is a need for forming an oil film of lubricating oil in apart where the lip seal plate and the rotor shaft are in contact with each other. Therefore, this structure cannot be applied to a ball bearing of grease lubrication.

SUMMARY OF THE INVENTION

A vacuum pump according to a preferred embodiment of the present invention includes a rotating body having a rotation side exhaust function portion and a rotor shaft, a stationary side exhaust function portion, a lubricated ball bearing for supporting the rotor shaft, a motor for rotating and driving the rotating body, and a first labyrinth seal provided between a space in which a motor stator of the motor is arranged and a space in which the lubricated ball bearing is arranged.

Preferably, there is no passage through which a gas flows between the space in which the motor stator is arranged and the space in which the lubricated ball bearing is arranged except the first labyrinth seal.

Preferably, the vacuum pump further includes a bearing holder for holding the lubricated ball bearing, and a balance adjustment member installed at a position of the rotor shaft to face the bearing holder and used for balance adjustment of the rotating body, wherein one concave and convex part forming the first labyrinth seal is formed on a surface of the balance adjustment member facing the bearing holder, and the other concave and convex part to be fitted to the one concave and convex part is formed on a surface of the bearing holder facing the balance adjustment member.

Preferably, the vacuum pump further includes a purge gas flow passage for introducing a purge gas to the space in which the motor stator is arranged.

Preferably, the vacuum pump further includes a second labyrinth seal provided between the space in which the motor stator is arranged and a pump exhaust port.

Preferably, the vacuum pump further includes an oil reservoir arranged so as to be closely attached to the motor stator, the oil reservoir in which grease or base oil of the grease to be used for the lubricated ball bearing is provided.

Preferably, the vacuum pump further includes a purge gas flow passage for introducing a purge gas to a seal gap of the second labyrinth seal.

According to the present invention, the life of the lubricated ball bearing can be extended.

DETAILED DESCRIPTION OF PREFERRED EMBODIMENTS

Hereinafter, modes for implementing the present invention will be described with reference to the drawings.

First Embodiment

Figure 1:
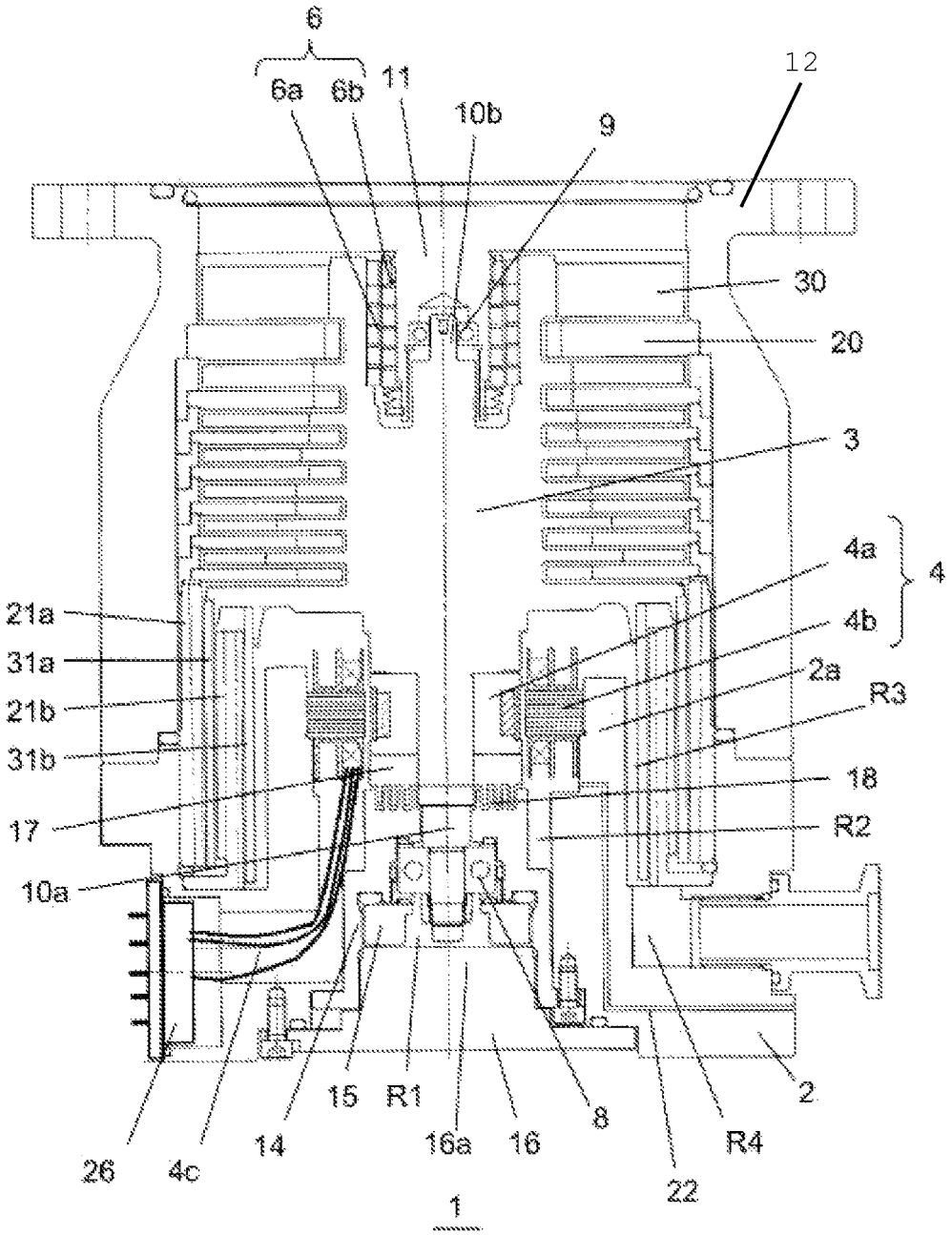
FIG. 1 is a view showing a first embodiment of a vacuum pump according to the present invention.

FIG. 1 is a view showing a first embodiment of a vacuum pump according to the present invention, the view being a sectional view of a turbo-molecular pump 1. It should be noted that although a power source unit for supplying electric power is connected to the turbo-molecular pump 1, the unit is not shown in FIG. 1.

The turbo-molecular pump 1 shown in FIG. 1 includes a turbo pump portion provided with turbine blades, and a Holweck pump portion provided with a spiral groove as exhaust function portions. As a matter of course, the present invention can be applied not only to the vacuum pump including the turbo pump portion and the Holweck pump portion as the exhaust function portions but also to a vacuum pump including only turbine blades, a vacuum pump including only a drag pump such as a Siegbahn pump and a Holweck pump, and a vacuum pump including a combination of the pumps.

The turbo pump portion includes plural steps of rotor blades 30 formed in a pump rotor 3, and plural steps of stationary blades 20 arranged alternately to the rotor blades 30. Meanwhile, the Holweck pump portion provided on the downstream side of the turbo pump portion includes a pair of cylindrical portions 31*a*, 31*b* formed in the pump rotor 3, and a pair of stators 21*a*, 21*b* arranged on the side of a base 2.

The pump rotor 3 is rotated and driven by a motor 4. A motor rotor 4*a* of the motor 4 is provided in a shaft portion 10*a* on the lower side of the pump rotor 3. A motor stator 4*b* is fixed to a motor housing portion 2*a* of the base 2. Wires 4*c* for supplying electric power to the motor stator 4*b* are connected to a connector 26 attached to the base 2. The pump rotor 3 is rotatably supported by a permanent magnet magnetic bearing 6 including a plurality of permanent magnets 6*a*, 6*b*, and a mechanical bearing 8.

The permanent magnets 6*a*, 6*b* are ring shape permanent magnets magnetized in the axial direction. The plurality of permanent magnets 6*a* provided on the side of the rotated pump rotor 3 is arranged in the axial direction so that the same poles face each other. Meanwhile, the plurality of permanent magnets 6*b* on the stationary side is installed in a magnet holder 11 fixed to a pump casing 12. The plurality of permanent magnets 6*b* is also arranged in the axial direction so that the same poles face each other.

An axial position of the permanent magnets 6*a* provided in the pump rotor 3 is set on the slightly upper side of a position of the permanent magnets 6*b* arranged on the inner peripheral side thereof. That is, a magnetic pole of the permanent magnets on the rotation side is displaced from a magnetic pole of the permanent magnets on the stationary side toward the intake port side in the axial direction by a predetermined amount. By magnitude of this predetermined amount, support force of the permanent magnet magnetic bearing 6 is differentiated. In an example shown in FIG. 1, since the permanent magnets 6*a* are arranged on the upper side in the figure, by reactive force of the permanent magnets 6*a* and the permanent magnets 6*b*, radial support force and axially upward force (in the pump intake port direction) act on the pump rotor 3.

A bearing 9 is held on the inner peripheral side of the magnet holder 11. The bearing 9 is to function as a touch down bearing for restricting radial oscillation of a shaft upper part. In a state where the pump rotor 3 is steadily rotated, a shaft portion 10*b* on the upper side of the pump rotor 3 and the bearing 9 do not come into contact with each other. In a case where large disturbance is added or whirling of the pump rotor 3 is increased at the time of acceleration or deceleration of rotation, the shaft portion 10*b* comes into contact with an inner race of the bearing 9. For example, deep groove ball bearings are used as the bearings 8, 9. Grease is enclosed into the bearing 8 on the lower side.

The bearing 8 is held by a bearing holder 14, and the bearing holder 14 is fixed to the base 2 by bolts. The bearing 8 is held by the bearing holder 14 via a damper or the like, and by fastening a nut 15 screwed to the bearing holder 14, an outer race of the bearing 8 is held by the bearing holder 14. An inner race of the bearing 8 is fixed to the side of the shaft portion 10*a*.

On the lower side of the bearing holder 14 in the figure, a lower lid 16 for sealing a lower part of a bearing arrangement space R1 is fixed to the base 2. A convex portion 16*a* is formed on the side of an inner peripheral surface of the lower lid 16, and this convex portion 16*a* comes into an inside region of the bearing holder 14, so that a gap region of the bearing arrangement space R1 is suppressed to be as small as possible.

A balance adjustment member 17 is attached to the shaft portion 10*a* on the lower side of the motor rotor 4*a*. The balance adjustment member 17 is a member used at the time of balance adjustment of the pump rotor 3, for reducing unbalance of the pump rotor 3, for example, by scraping a side peripheral surface as in the reference sign V or installing a locking screw into a screw hole (not shown) provided on the side peripheral surface. Ring shape concave and convex parts forming a labyrinth seal 18 are formed on a lower surface of this balance adjustment member 17 and an upper surface of the bearing holder 14 facing the lower surface.

Figure 2:
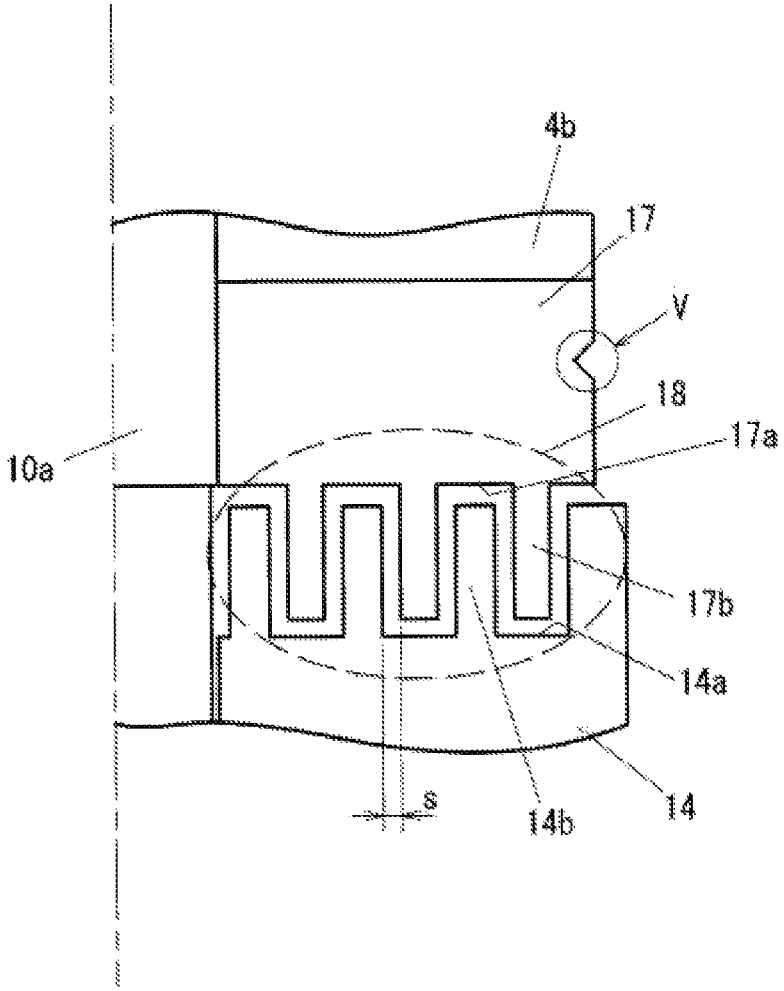
FIG. 2 is a view for illustrating a structure of a labyrinth seal 18.

FIG. 2 is a view for illustrating a structure of the labyrinth seal 18, the view being an enlarged view of a part of the labyrinth seal 18 in FIG. 1. The labyrinth seal is a non-contact seal for reducing leakage by combining gaps of the concave and convex parts in several steps between the rotor shaft and the stationary part. A plurality of concentric ring shape concave portions 17*a* and convex portions 17*b* are formed on the lower surface side of the balance adjustment member 17. Similarly, a plurality of concentric ring shape concave portions 14*a* and convex portions 14*b* are also formed on the upper surface of the bearing holder 14. The convex portions 17*b* of the balance adjustment member 17 come into the concave portions 14*a* of the bearing holder 14, and conversely, the convex portions 14*b* of the bearing holder 14 come into the concave portions 17*a* of the balance adjustment member 17. A slight gap is formed between the concave portions and the convex portions. With a whirling radius r of the shaft portion 10*a* and a gap g between the motor rotor 4*a* and the motor stator 4*b*, a radial gap s is set as $r<s<g$.

In such a way, since the gap of the concave and convex portions is set to be small, conductance of the labyrinth seal 18 is small. For example, in a case of r=0.2 mm, g=0.5 mm, s=0.35 mm, the conductance of the labyrinth seal formed by multiple cylinders is about 0.06 L/s with respect to a nitrogen gas. The conductance is further reduced with respect to a gas of large molecular weight such as oil vapor. This is sufficiently smaller than exhaust speed of a pump to be generally used as an auxiliary pump of a turbo-molecular pump, and sufficiently functions as a seal for sealing the oil vapor.

The bearing arrangement space R1 of the bearing 8 is connected to a motor arrangement space R2 via a gap between the shaft portion 10*a* and the bearing holder 14 and the gap of the labyrinth seal 18. Further, the motor arrangement space R2 communicates with a pump exhaust port side space R4 via a gap R3 between an outer periphery of the motor housing portion 2*a* and the cylindrical portion 31*b* of the pump rotor 3. It should be noted that the motor arrangement space R2 is connected to a space in which the wires 4*c* and the connector 26 are arranged.

The bearing 8 is lubricated by a lubricant such as oil or grease. In the present embodiment, grease is used as a lubricant of the bearing 8. Since a bearing used for a vacuum pump is used in vacuum, oil and base oil of grease are easily evaporated. Therefore, when the base oil is evaporated and gone, the lubricating life is terminated. Since a temperature of the bearing 8 is high at the time of operating the pump, evaporation of the base oil is facilitated, and vapor thereof is diffused to the entire gap region of the bearing arrangement space R1 in which the bearing 8 is arranged. A partial pressure of the base oil in the bearing arrangement space R1 is increased until the evaporation of the base oil and re-condensation come to equilibrium. As described above, the labyrinth seal 18 has sufficiently small conductance with respect to the oil vapor. Thus, unless air comes in and out via the labyrinth seal, a decrease in the base oil of the lubricant by the evaporation is extremely small at a time point of reaching an equilibrium state.

However, when a pressure of the pump exhaust port side space R4 is changed in accordance with pump exhaust, the air comes in and out between the pump exhaust port side space R4 and the motor arrangement space R2 via the gap R3, and further, the air comes in and out between the motor arrangement space R2 and the bearing arrangement space R1 via the labyrinth seal 18. For example, in a case where a gas inflow/stop operation is performed to a chamber to which the pump is installed, the pressure of the pump exhaust port side space R4 is increased at the time of gas inflow and lowered at the time of gas stop. Therefore, at the time of the gas stop after the gas inflow, the oil vapor of the bearing arrangement space R1 flows out to the motor arrangement space R2. In particular, in a case where the pressure of the pump exhaust port side space R4 is increased to a viscous flow, the oil vapor filled in the bearing arrangement space R1 is pushed away to the exhaust port side by molecular collision with the exhaust gas.

In a case where the pressure of the pump exhaust port side space R4 is lower than that of the motor arrangement space R2 at the time of the gas stop, the gas of the motor arrangement space R2 flows into the gap region of the bearing arrangement space R1. When a vapor pressure of the base oil of the motor arrangement space R2 is lowered by this gas inflow, the base oil is evaporated again until reaching the equilibrium state.

A flow-out amount of the oil vapor from the bearing arrangement space R1 by such coming-in and out of the gas is substantially proportional to the product between capacity of the bearing arrangement space R1 (volume of the gap region of the bearing arrangement space R1) and frequency of a pressure change. Therefore, in the present embodiment, by providing the labyrinth seal 18 so as to substantially separate the bearing arrangement space R1 and the motor arrangement space R2, and reducing the gap space of the separated bearing arrangement space R1 as far as possible, the evaporation of the base oil of the lubricant is reduced, so that the lubricating life is extended.

As shown in FIG. 1, by providing the labyrinth seal 18 between the motor arrangement space R2 and the bearing arrangement space R1, substantial separation between the motor arrangement space R2 and the bearing arrangement space R1 is achieved. The substantial separation indicates that unless there is no pressure change in the pump exhaust port side space R4, the motor arrangement space R2 and the bearing arrangement space R1 are sealed by the labyrinth seal 18 provided therebetween. As a result, the bearing arrangement space R1 is connected to the motor arrangement space R2 and the pump exhaust port side space R4 with a connection structure of (bearing arrangement space R1)—(labyrinth seal 18)—(motor arrangement space R2)—(gap R3)—(pump exhaust port side space R4). Therefore, a region in which the oil vapor is filled can be limited to the bearing arrangement space R1, and regarding flow-out of the oil vapor, the flow-out from the bearing arrangement space R1 whose gap capacity is small to the motor arrangement space R2 is to be considered. Since the capacity of the space in which the oil vapor is filled is reduced, the flow-out amount of the oil vapor can be suppressed to be small.

As shown in FIG. 1, since the convex portion 16*a* of the lower lid 16 comes into the inside region of the bearing holder 14 (that is, into the bearing arrangement space), the gap region of the bearing arrangement space R1 is reduced as far as possible. It should be noted that this region into which the convex portion 16*a* comes is a space required as a working space at the time of attaching and detaching the nut 15.

In such a way, by reducing the gap region of the bearing arrangement space R1 as far as possible, the space in which the oil vapor is filled is reduced. Therefore, a moving amount of the gas in a case where the gas comes out and in between the bearing arrangement space R1 and the motor arrangement space R2 by the pressure change can be suppressed to be as small as possible. As a result, the decrease in the base oil of the lubricant of the bearing 8 can be suppressed, so that the lubricating life can be extended.

Meanwhile, with the above pump described in Japanese Unexamined Patent Publication No. 2002-317790, since a motor arrangement space and a bearing arrangement space are connected, oil vapor is evaporated in both the spaces, and further, a gas moving amount at the time of a pressure change is more increased. Therefore, more oil vapor flows out to the exhaust port side, so that the lubricating life is shortened.

Further, as shown in FIG. 1, since the concave and convex parts forming the labyrinth seal 18 are formed in the conventionally provided parts (the bearing holder 14, and the balance adjustment member 17), an increase in the number of parts can be suppressed and an increase in pump axial size can also be suppressed.

It should be noted that with the pump shown in FIG. 1, as a cooling measure of the motor 4 and the shaft portion 10*a*, and an anti-corrosion measure of a case where a corrosive gas is exhausted, a purge gas flow passage 22 for introducing a purge gas to the motor arrangement space R2 is formed in the base 2. In such a way, by introducing the purge gas to the motor arrangement space R2 partitioned by the labyrinth seal 18, at the time of gas purge, the oil vapor can be prevented from flowing out to the pump exhaust port side space R4.

Second Embodiment

Figure 3:
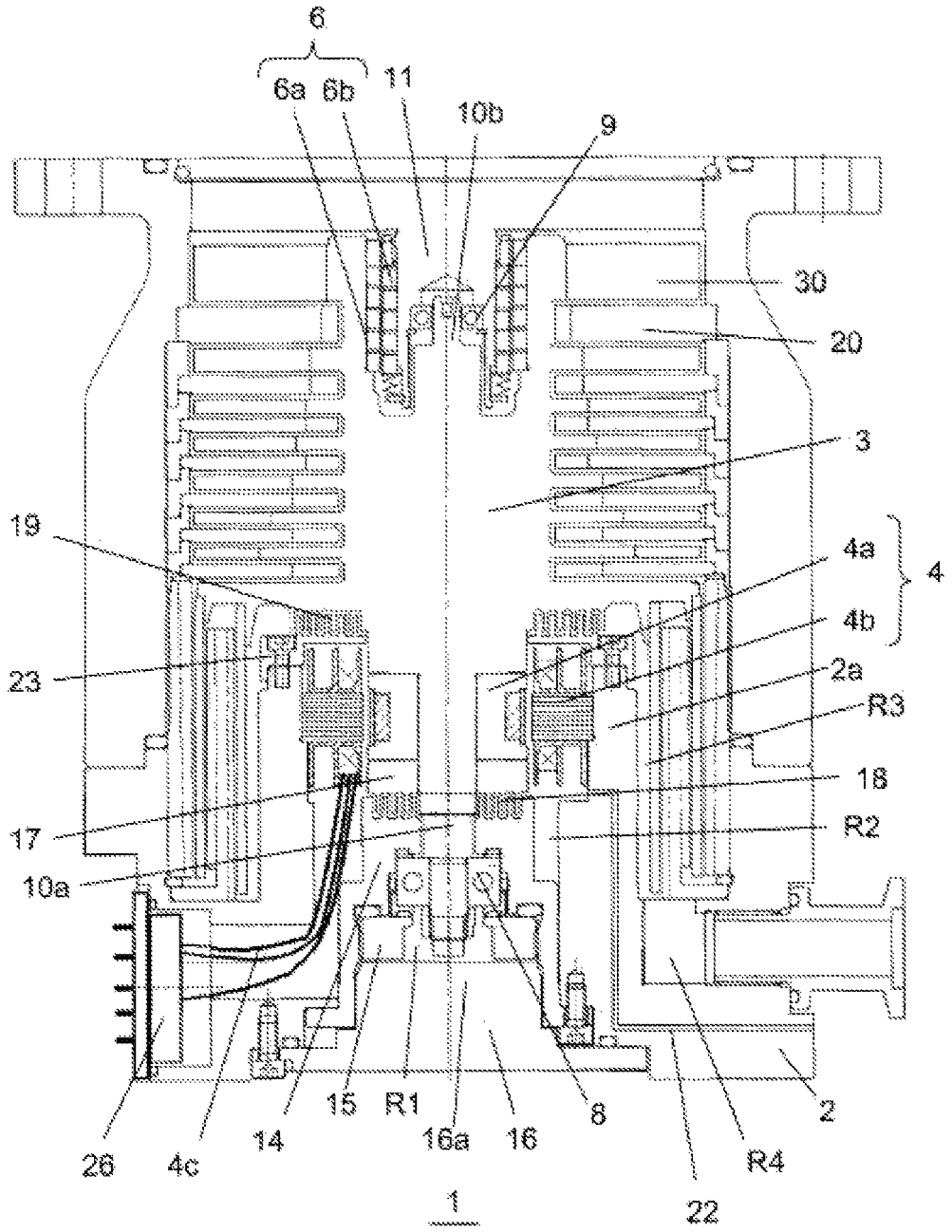
FIG. 3 is a view showing a second embodiment of the vacuum pump according to the present invention.

FIG. 3 is a view showing a second embodiment of the vacuum pump according to the present invention. In the present embodiment, a motor cover 23 and a labyrinth seal 19 are further provided in the configuration of the first embodiment shown in FIG. 1. Other configurations than the motor cover 23 and the labyrinth seal 19 are the same as the vacuum pump shown in FIG. 1, and hereinafter, parts of the motor cover 23 and the labyrinth seal 19 will be mainly described.

The motor cover 23 is provided to prevent the gas of the pump exhaust port side space R4 from flowing into the motor arrangement space R2 via the gap R3. In the present embodiment, the labyrinth seal 19 is formed by forming a plurality of ring shape concave and convex parts on an upper surface of this motor cover 23 and also forming a plurality of ring shape concave and convex parts on a facing surface of the rotor 3. Regarding the concave and convex parts of the motor cover 23 and the concave and convex parts of the rotor 3, convex portions come into concave portions. By adopting such a structure, the labyrinth seal 19 is provided between the gap R3 and the motor arrangement space R2.

With the vacuum pump of the second embodiment, by providing the labyrinth seal 19, in a case where the pressure of the pump exhaust port side space R4 is changed, the gas moving amount between the pump exhaust port side space R4 and the motor arrangement space R2 can be suppressed to be small. As a result, the gas moving amount between the motor arrangement space R2 and the bearing arrangement space R1 is also reduced more than the case of the vacuum pump shown in FIG. 1. Therefore, the decrease in the base oil of the lubricant of the bearing 8 can be further suppressed, so that the lubricating life can be further extended. In a case of this configuration, since the labyrinth seal 19 is also formed by utilizing the motor cover 23 and a lower surface of the rotor 3, axial height of the vacuum pump can be suppressed and a cost increase due to the increase in the number of parts can also be suppressed.

By providing the labyrinth seal 19, an inflow amount of the corrosive gas into the motor arrangement space R2 at the time of exhausting the corrosive gas can be reduced. At the time of exhausting the corrosive gas, the purge gas is introduced from the purge gas flow passage 22 to the motor arrangement space R2.

Third Embodiment

Figure 4:
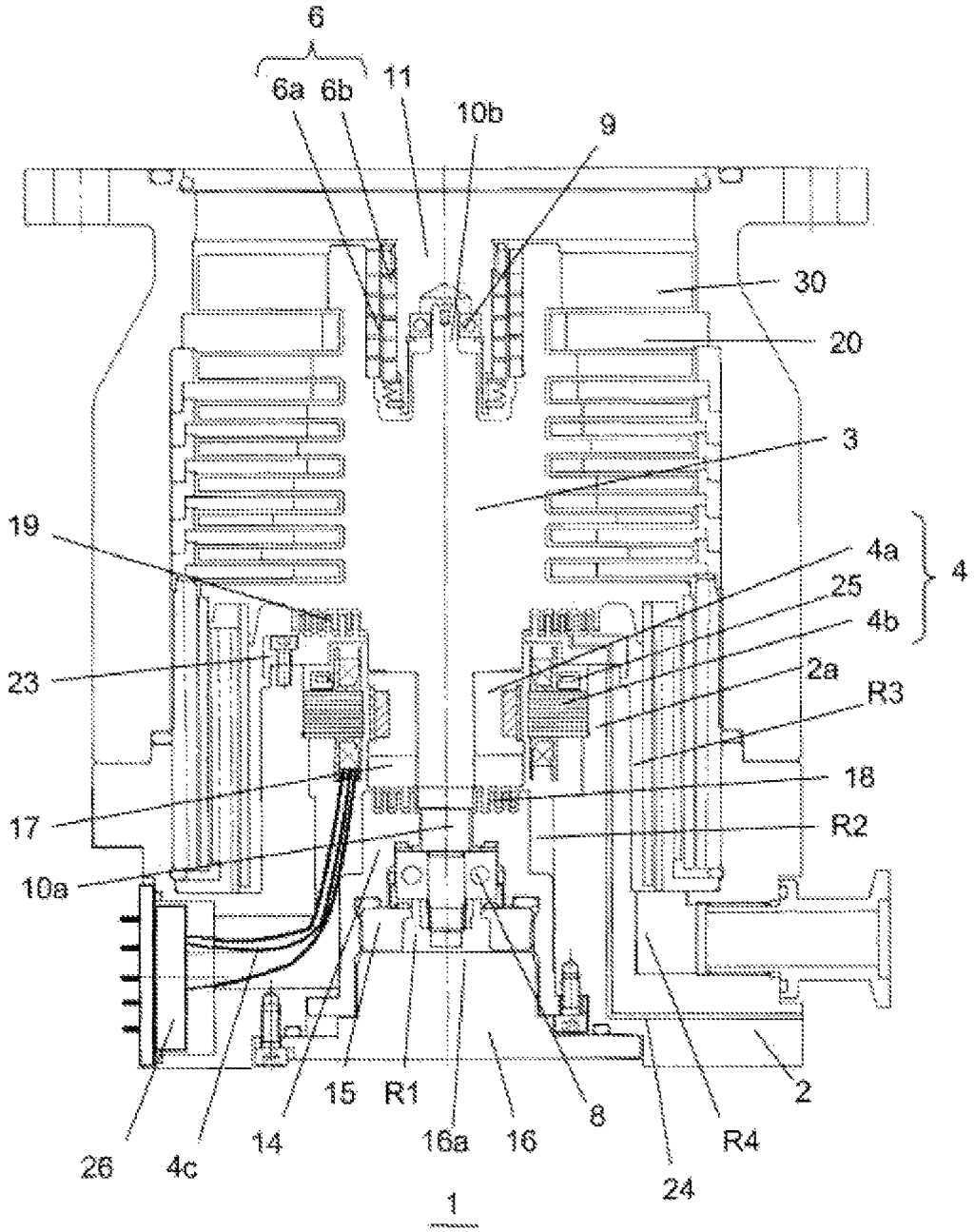
FIG. 4 is a view showing a third embodiment of the vacuum pump according to the present invention.

FIG. 4 is a view showing a third embodiment of the present invention. In the present embodiment, an oil reservoir 25 is further provided in the vacuum pump shown in FIG. 3. In addition to addition of the oil reservoir 25, the purge gas is introduced to a part of the labyrinth seal 19 (gap of the seal). In this case, a purge gas flow passage 24 formed in the base 2 is connected to a purge gas flow passage 24 formed in the motor cover 23, so that a flow-out port is formed in the part of the labyrinth seal 19.

The oil reservoir 25 shown in FIG. 4 is a ring shape member having a section formed in a C shape, and is secured to a core upper surface of the motor stator 4*b*. On the inner side of the C shape part of the oil reservoir 25, grease or base oil of the grease used for the bearing 8 is held. When the motor 4 is driven, a temperature of the motor stator 4*b* is increased by heat generation of the motor, the base oil of the oil reservoir 25 is evaporated, and the oil vapor of the motor arrangement space R2 has a vapor pressure corresponding to the core temperature. It should be noted that a shape of the oil reservoir 25 is not limited to the above shape as long as the oil reservoir has the above evaporation function.

The temperature of the stator core of the motor stator 4*b* is increased equivalent to or more than that of the bearing 8 by hysteresis loss or Joule heat due to a coil current. Therefore, an oil vapor pressure of the motor arrangement space R2 is higher than an oil vapor pressure of the bearing arrangement space R1. Thus, even when the gas is moved between the motor arrangement space R2 and the bearing arrangement space R1, due to a higher oil vapor pressure of the motor arrangement space R2, the decrease in the base oil of the bearing lubricant (grease) by gas movement can be prevented. Therefore, the life of the lubricant of the bearing 8 can be extended.

Since the purge gas is introduced to the part of the labyrinth seal 19 (gap of the seal), at the time of gas purge, the oil vapor of the motor arrangement space R2 can be prevented from flowing out to the gap R3 by the purge gas.

Figure 5:
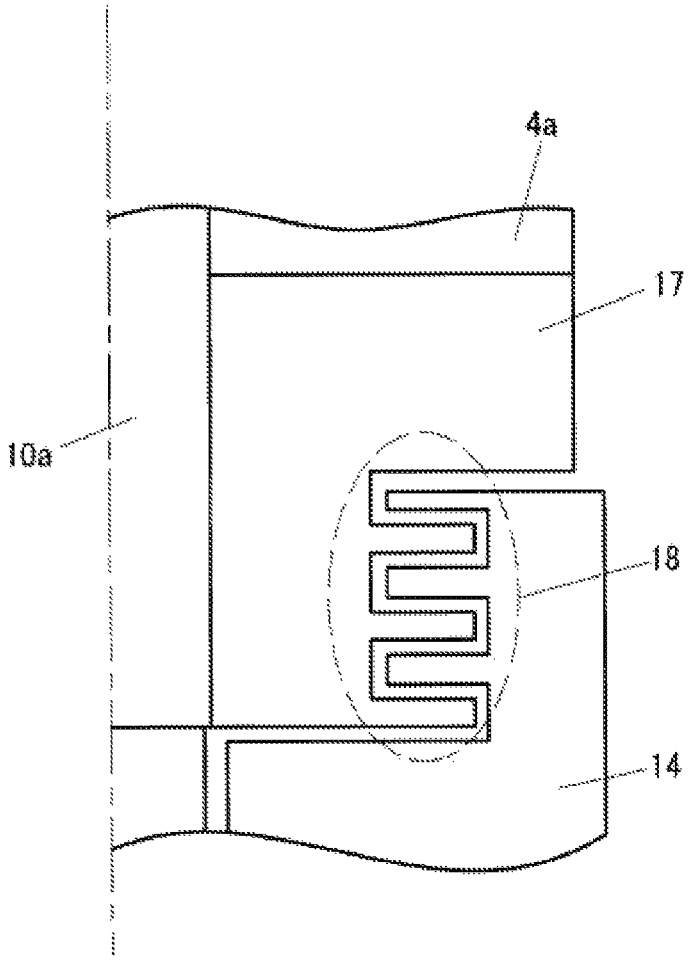
FIG. 5 is a view showing an axial type labyrinth seal 18.

It should be noted that although the radial type labyrinth seal 18 is provided in the above embodiments, an axial type labyrinth seal 18 as shown in FIG. 5 may be provided. Although a passive magnetic bearing using the permanent magnets is taken as an example of the bearing to be used in pair with the lubricated ball bearing, an active control magnetic bearing may be used.

The above embodiments may be used independently or in combination. This is because effects in the embodiments can be obtained independently or synergistically. The above description is just one example. Upon interpreting the invention, a corresponding relationship between the matters described in the above embodiments and the matters described in the claims does not limit or restrict at all.

What is claimed is:

1. A vacuum pump comprising:

a rotating body having a rotation side exhaust function portion and a rotor shaft;

a stationary side exhaust function portion;

a lubricated ball bearing for supporting the rotor shaft;

a motor for rotating and driving the rotating body;

a first labyrinth seal provided between a space in which a motor stator of the motor is arranged and a space in which the lubricated ball bearing is arranged;

a bearing holder for holding the lubricated ball bearing; and a balance adjustment member installed at a position on the rotor shaft to face the bearing holder and used for a balance adjustment of the rotating body, wherein a first concave and convex part forming the first labyrinth seal is formed on a surface of the balance adjustment member facing the bearing holder, and a second concave and convex part to be fitted to the first concave and convex part is formed on a surface of the bearing holder facing the balance adjustment member.

2. The vacuum pump according to claim 1, further comprising:

a purge gas flow passage for introducing a purge gas to the space in which the motor stator is arranged.

3. The vacuum pump according to claim 1, further comprising:

a second labyrinth seal provided between the space in which the motor stator is arranged and a pump exhaust port.

4. The vacuum pump according to claim 3, further comprising:

an oil reservoir arranged so as to be attached to the motor stator, the oil reservoir in which a grease or base oil of the grease to be used for the lubricated ball bearing is provided.

5. The vacuum pump according to claim 3, further comprising:

a purge gas flow passage for introducing a purge gas to a seal gap of the second labyrinth seal.

6. A vacuum pump comprising:

a rotating body having a rotation side exhaust function portion and a rotor shaft;

a stationary side exhaust function portion;

a lubricated ball bearing for supporting the rotor shaft;

a motor for rotating and driving the rotating body; and a first labyrinth seal provided between a space in which a motor stator of the motor is arranged and a space in which the lubricated ball bearing is arranged, wherein a first concentric ring shape concave and convex part made up of a first multiple of concentric hollow cylinders forming the first labyrinth seal is formed in a radial direction on a surface of a rotating member facing a stationary member, and a second concentric ring shape concave and convex part made up of a second multiple of concentric hollow cylinders to be fitted to the first concave and convex part is formed in the radial direction on a surface of the stationary member, and further comprising:

a bearing holder for holding the lubricated ball bearing, and a balance adjustment member installed at a position on the rotor shaft and used for a balance adjustment of the rotating body, wherein the rotating member comprises the balance adjustment member and the first concave and convex part forming the first labyrinth seal is formed on a surface of the balance adjustment member facing the bearing holder.

7. The vacuum pump according to claim 6, further comprising:

the bearing holder for holding the lubricated ball bearing, wherein the second concave and convex part is formed on a surface of the bearing holder.

8. The vacuum pump according to claim 6, further comprising:

a purge gas flow passage for introducing a purge gas to the space in which the motor stator is arranged.

9. The vacuum pump according to claim 6, further comprising:

a second labyrinth seal provided between the space in which the motor stator is arranged and a pump exhaust port.

10. The vacuum pump according to claim 9, further comprising:

an oil reservoir arranged so as to be attached to the motor stator, the oil reservoir in which a grease or base oil of the grease to be used for the lubricated ball bearing is provided.

11. The vacuum pump according to claim 9, further comprising:

a purge gas flow passage for introducing a purge gas to a seal gap of the second labyrinth seal.

12. The vacuum pump according to claim 6, wherein there is no passage through which a gas flows between the space in which the motor stator is arranged and a space in which the lubricated ball bearing is arranged except the first labyrinth seal.

13. The vacuum pump according to claim 6, wherein a gap between the first concentric ring shape concave and convex parts and the second concentric ring shape concave and convex parts of the first labyrinth seal is small so that a conductance of the first labyrinth seal is small enough to seal oil vapor in the space in which the lubricated ball bearing is arranged.

* * * * *